US005536149A

United States Patent [19]

Fujii et al.

[11] Patent Number: 5,536,149

[45] Date of Patent: Jul. 16, 1996

[54] SUPPORT STRUCTURE FOR ROTARY SHAFT OF COMPRESSOR

[75] Inventors: Toshiro Fujii; Koichi Ito; Kazuaki Iwama; Katsuya Ohyama; Yuichi Kato, all of Kariya, Japan

[73] Assignee: Kabushiki Kaisha Toyoda Jidoshokki Seisakusho, Kariya, Japan

[21] Appl. No.: 277,196

[22] Filed: Jul. 19, 1994

[30] Foreign Application Priority Data

Jul. 19, 1993 [JP] Japan ..... 5-178356

[51] Int. Cl.[6] ..... F04B 27/08; F04D 13/02

[52] U.S. Cl. ..... 417/269; 417/365

[58] Field of Search ..... 417/269, 272, 417/365

[56] References Cited

U.S. PATENT DOCUMENTS 4,227,865 10/1980 Erickson ..... 417/365
4,762,468 8/1988 Ikeda et al. ..... 417/269
5,094,590 3/1992 Carella et al. .
5,181,834 1/1993 Ikeda et al. ..... 417/269

FOREIGN PATENT DOCUMENTS 662305 6/1938 Germany .
2837639 3/1979 Germany ..... 417/269

*Primary Examiner*—Richard E. Gluck
*Attorney, Agent, or Firm*—Brooks Haidt Haffner & Delahunty

[57] ABSTRACT

A piston-reciprocating type compressor has a disk mounted on a rotary drive shaft and operably coupled to a piston. The piston compresses refrigerant gas in a cylinder bore with a compressive force according a cooling load. A retaining chamber formed in the vicinity of an end of the drive shaft. A partition is housed in the retaining chamber. Two recesses are formed with the opposite sides of the partition in the moveable manner. The compressed gas is supplied to the recesses under pressure in proportion to the cooling load. A thrust bearing which connects with the partition supports an end of the drive shaft. The drive that is biased in the direction counter to a thrust load acting on the drive shaft.

13 Claims, 4 Drawing Sheets

SUPPORT STRUCTURE FOR ROTARY SHAFT OF COMPRESSOR

BACKGROUND OF THE INVENTION

1. Field of the Invention

The present invention relates to a support structure for the rotary drive shaft of a reciprocating-piston type compressor such as a swash plate type compressor.

2. Description of the Related Art

In a reciprocating-piston type compressor, a swash plate rotates together with a rotary drive shaft for causing a plurality of pistons to reciprocate in their respective cylinder bores compressing refrigerant gas supplied into the cylinder bores from an eternal source. During this compressing process, a thrust load based on a compressive force acts on the drive shaft via the pistons and the swash plate. This compressive force causes the drive shaft to rotate with an irregular axial and radial displacement, resulting in excessive vibration rattling, shortening of life of compressor, etc.

Conventional compressors typically utilize a spring to apply a pre-load force to the drive shaft that counters the thrust load acting on the drive shaft. With such a construction, however, the magnitude of the thrust load acting on the drive shaft varies in accordance with the cooling load and other loads effecting the compressor, etc. Since this pre-load force counters that of the thrust load that acting on the drive shaft, the magnitude of the pre-load force is usually preset to a value greater than the maximum value of the thrust load. In an operation under a small cooling load where a small thrust load acts on the drive shaft, the pre-load force is typically and unnecessarily large. Consequently, the shaft receives an excess load, causing power loss in the compressor.

The magnitude of the pre-load force applied to the shaft may also be affected by variation in the manufacturing tolerances of the spring, such as size, spring force, etc. These variation constitutes to deviation in the pre-load force actually applied to the drive shaft. This, in effect, contributes to the tendency of the conventional compressor to experience power loss and a rattling of the drive shaft in the compressor due to an excessive pre-load force.

SUMMARY OF THE INVENTION

The present invention is accomplished with a view to solving the problems involved in the above-mentioned prior art, and it is an object of the present invention to provide a support structure for the of a reciprocation type compressor to which the proper pre-load is always applied regardless of the size of the cooling load and which allows a stable pre-load to be applied to each product.

To achieve the above object, according to one aspect of this invention, there is provided a compressor having a disk mounted on a rotary drive shaft and operably coupled to a piston for converting a rotation of the drive shaft to a reciprocating movement of the piston to compress refrigerant gas in a cylinder bore with a compressive force according a cooling load of the compressor, and an element for biasing the drive shaft in the direction counter to a thrust load applied on the drive shaft and resulted from the compressive force working on the drive shaft. The element comprises means for generating a pre-load force substantially counterbalancing the thrust load force, and means for transmitting the counterbalancing pre-load force to the drive shaft.

DETAILED DESCRIPTION OF THE PREFERRED EMBODIMENTS

A swash plate type compressor according to a first embodiment of the present invention will now be described referring to FIGS. 1 and 2.

Figure 1:
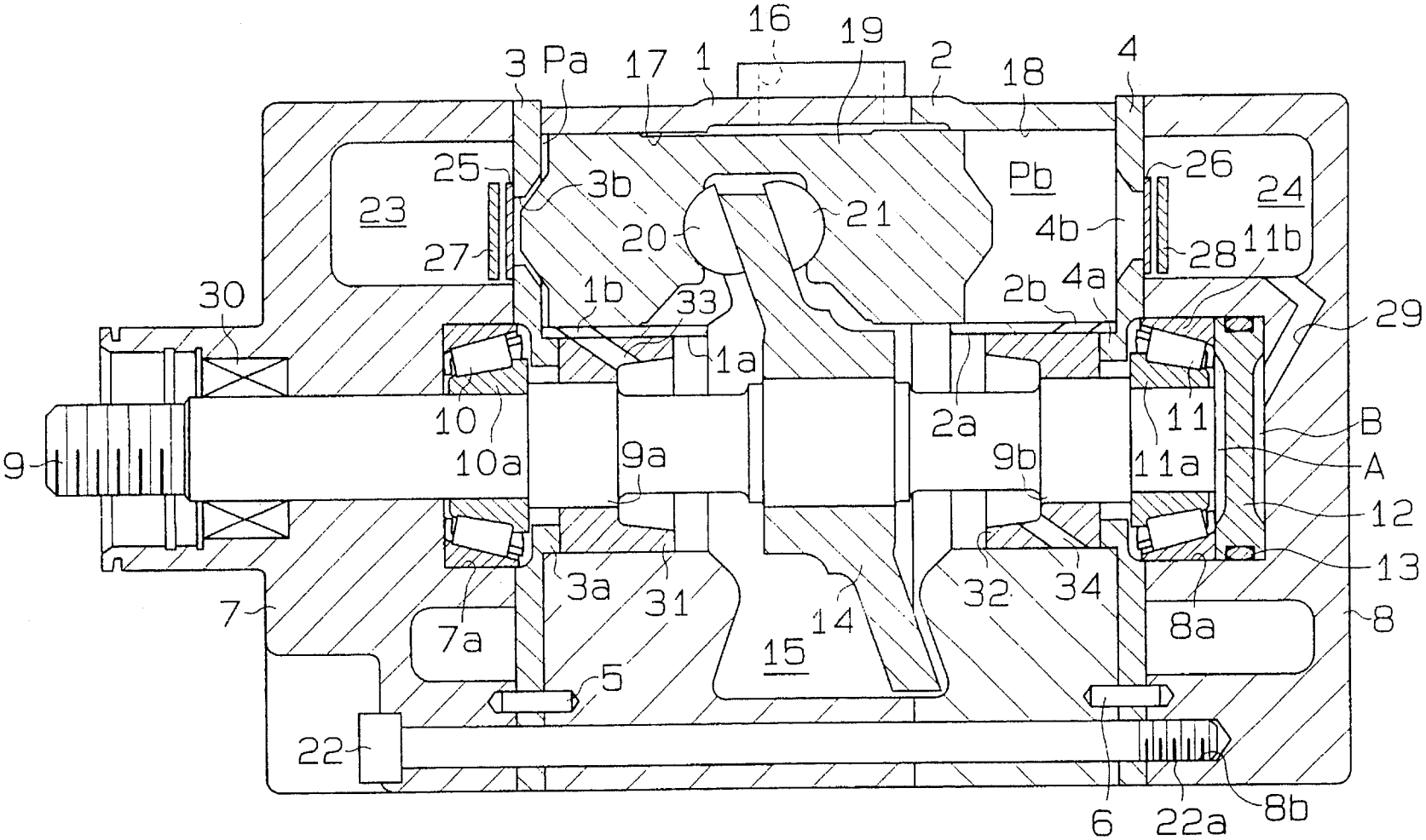
FIG. 1 is a vertical cross-sectional view illustrating an overall swash plate type compressor according to a first embodiment of the present invention.

As shown in FIG. 1, a compressor's housing has a pair of cylinder blocks 1, 2 connected to each other. Valve plates 3, 4 respectively attached to the end faces of the cylinder blocks 1, 2 have annular projections *3a*, *4a* protrusively formed at the center portions of each valve plates. A front housing 7 is connected to the front end face of the valve plate 3. Likewise, a rear housing 8 is connected to the rear end face of the valve plate 4.

Retaining holes *1a*, *2a* are respectively bored through the center portions of the cylinder blocks. Support holes *7a*, *8a*, in the center portions of the front and rear housings 7, 8 contain roller bearings 10, 11 both of which function to support a rotary shaft 9. Each of the bearings 10, 11 has its roller shaft located on a conical surface, and each are capable of receiving a thrust and radial load applied to the drive shaft 9. Movable races *10a*, *11a* of the bearings 10, 11 respectively abut against step portions *9a*, *9b* provided on the drive shaft 9. This construction effectively reduces the number of the compressor's component parts.

In the support hole *8a* of the rear housing 8, a partition 12 is provided. The partition engages the rear face of a fixed race *11b* of the bearing 11 and is movable forward and backward. A seal ring 13 is attached on the outer surface of the partition 12 to keep the air-tight sealing between the partition 12 and the retaining chamber *8a*. First and second recesses A, B are respectively defined in front and at the rear sides of the partition 12. The incorporation of the partition 12 in the retaining chamber *8a* not only simplifies the overall design of the compressor, but also permits the design of a smaller sized compressor, in contrast to a design having the retaining chamber located in the front housing 7.

The thrust load on the drive shaft 9, acting in the direction from the front housing 7 to the rear housing 8, 7 is received by the rear housing 8 via the bearing 11 and the partition 12. In a similar fashion, the thrust load on the drive shaft 9, acting the direction from the rear housing 8 to the front housing 7, is received by the front housing 7 via the bearing 10.

A swash plate 14 is securely supported on the drive shaft 9 in a chamber 15 defined between the cylinder blocks 1, 2.

An unillustrated external refrigerant circuit (not shown) couples to the cylinder blocks 1,2 through an inlet port 16.

Plural pairs of front and rear cylinder bores 17, 18 are formed in the cylinder blocks 1, 2 at equiangular positions around the drive shaft 9. A double-headed piston 19 is reciprocatably disposed in the cylinder bores 17, 18. Hemispherical shoes 20, 21 are respectively interposed between heads of the piston 19 and both surfaces of the swash plate 14. As the swash plate 14 rotates, therefore, the double-headed pistons 19 reciprocate forward and backward in the associated cylinder bores 17, 18. The compressor in this way compresses the refrigerant gas supplied from the external source. The cylinder blocks 1, 2, the valve plates 3, 4 and the housings 7, 8 are securely fastened together at a plurality of locations by bolts 22. Each bolt 22 has a screw portion 22*a* at its distal end, which is fastened into an associated screw hole 8*b* formed in the housing 8. Pins 5, 6 inhibit the rotation of the valve plates 3, 4 and the housings 7, 8 with respect to the cylinder blocks 1, 2. Discharge chambers 23, 24 are formed in the housings 7, 8. compression chambers Pa, Pb defined in the cylinder bores 17, 18 by the associated double-headed piston 19 can communicate with the discharge chambers 23, 24 via discharge ports 3*b*, 4*b* in the valve plates 3, 4. The discharge ports 3*b*, 4*b* are respectively opened or closed by flapper type discharge valves 25, 26. Retainers 27, 28 restrict the amount by which each of the values 25, 26 open or close. The discharge chambers 23, 24 communicate via discharge passages (not shown) with an external refrigerant gas circuit (also not shown). The discharge chamber 24 is connected via a passage 29 to the second recess B.

A lip seal 30 prevents the flow of the refrigerant gas from leaking out of the compressor along the drive shaft 9 from the swash plate chamber 15.

Rotary valves 31, 32 are securely supported at the step portions 9*a*, 9*b* on the drive shaft 9. The rotary valves 31, 32 are respectively accommodated in the retaining holes 1*a*, 2*a*. A slight clearance forming a passage between the rotary valve 32 and the drive shaft 9, allows the refrigerant gas supplied to the swash plate chamber 15 to reach the first recess A.

A pair of suction passages 33, 34 respectively formed in the rotary valves 31, 32 have inlet ports that open into the swash plate chamber 13 and outlet ports that open onto the inner surfaces of the retaining holes 1*a*, 2*a*. Suction ports 1*b*, 2*b* are respectively formed with the walls between the retaining holes 1*a*, 2*a* and the cylinder bores 17, 18.

During the suction stroke when the double-headed piston 19 moves to the bottom dead center from the top dead center, the suction passages 33, 34 respectively communicate with the compression chambers Pa, Pb in the cylinder bores 17, 18 as the rotary valves 31, 32 rotate. As a result, the refrigerant gas in the swash plate chamber 15 is led supplied to the compression chambers Pa, Pb in the cylinder bores 17, 18 via the suction passages 33, 34.

During the discharge stroke when the double-headed piston 19 moves to the top dead center from the bottom dead center in the associated cylinder bores 17, 18, the suction passages 33, 34 are blocked from the compression chambers Pa, Pb in the cylinder bores 17, 18. As a result, refrigerant gas in the compression chambers Pa, Pb forces the discharge valves 25, 26 open, and flows into the discharge chambers 23, 24 via the discharge ports 3*b*, 4*b*.

The operation of the above described compressor will now be given.

When the compressor is activated, refrigerant gas in the swash plate chamber 15 is fed via the suction passages 33, 34 and suction ports 1*b*, 2*b* to the compression chambers Pa, Pb where the gas is compressed. The compressed refrigerant gas is next discharged into the discharge chambers 23, 24 via the ports 3*b*, 4*b* and valves 25, 26.

During this compression, the gas pressure in the swash plate chamber 15 is transmitted to the first recess A via the passage between the rotary valve 32, the drive shaft 9 and through the bearing 11. The pressure of the refrigerant gas, compressed in the compression chamber Pb, is supplied to the discharge chamber 24 and transmitted to the second recess B via the passage 29. Accordingly, a difference in pressure occurs in the front and rear sides of the partition 12. This results in the partition 12 being pushed frontward. This applies a pre-load force F0 to the bearing 11 in the direction toward the swash plate 14. This pre-load force F0 acts on the drive shaft 9 via the step portion 9*b* as well as on the bearing 10 via the drive shaft 9 and the step 9*a*. The pre-load force F0 applied to the bearing 11, moreover, works against the thrust load which is directed toward the rear housing 8 from the front housing 7.

If the compressor is activated when the cooling lead is large, the difference between the suction and discharge pressures of the refrigerant gas will likewise be large. This creates a large pressure differential between the first and second recesses A, B in the front and rear sides of the partition 12. Consequently, the partition 12 is urged in physical contact against the bearing 11. Therefore, a relatively large pre-load force F0 will be applied to the bearings 10, 11.

When the compressor operates with a peak cooling load and with high suction pressures in the compression chambers Pa, Pb, a relatively large thrust lead is applied to the drive shaft 9 via the piston 19 and swash plate 14. If, at this time, a large pre-load force F0 is applied to the bearings 10, 11, the pre-load force F0 effectively opposes the thrust load force acting on the drive shaft 9.

On the other hand, under conditions when the cooling load is relatively small, for example, after a long period of compressor operation, the difference between the suction and discharge pressures of the refrigerant gas decreases. This reduces the pre-load force F0 applied to the bearing 11, as well as to the bearing 10. During periods when the cooling load is small and when the suction pressure is low, the thrust load acting on the drive shaft 9 becomes relatively small. Thus, even the small pre-load force F0 can oppose or work against a thrust load force.

Figure 2:
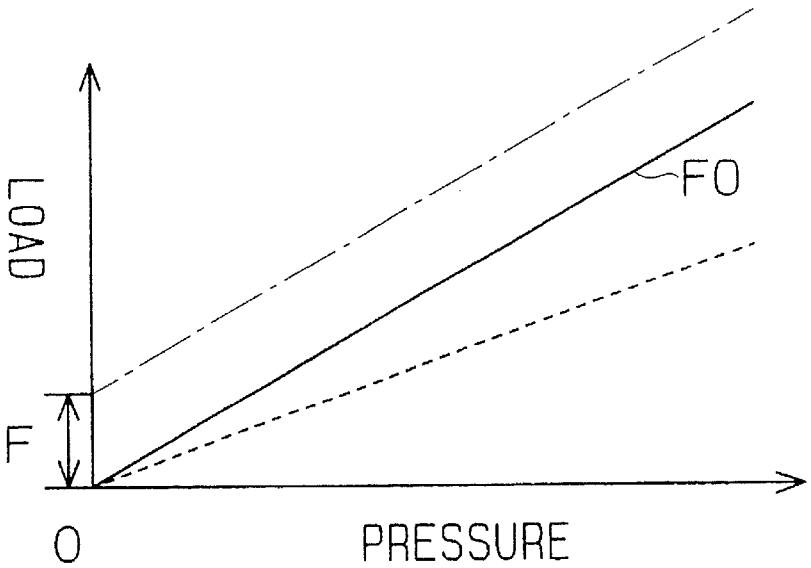
FIG. 2 is a graph illustrating the relationship between a pre-load force and a thrust load force applied to the compressor's drive shaft.

In FIG. 2, the broken line indicates the values of the thrust load force acting on the drive shaft as the compressor runs, and the solid line indicates the values of the pre-load force F0 of the compressor. It is apparent from this diagram that the pre-load force F0 is set to be slightly greater than the thrust load force acting on the drive shaft 9 for the compressor of this embodiment irrespective of the magnitude of the thrust load force or of the amount of the cooling load. The pre-load force F0 therefore always opposes or works against the thrust load force.

The pre-load force F0 acts not only on the steps 9*a*, 9*b* of the drive shaft 9 as a load in the thrust direction, but also on the drive shaft 9 as a load in the radial direction. According to this embodiment, the pre-load force F0 is set to always be slightly greater than the thrust load force. This prevents unnecessarily large loads in both the thrust and radial directions from affecting the drive shaft 9. As a result, the effects of rotational torque on the drive shaft can be reduced, and power loss during compressor operations suppressed. This, in turn, improves the durability of the bearings 10, 11.

Control of this pre-load force in the compressor, according to the present invention, can be performed with such stability that the value set for the pre-load force F0 relative to the thrust load force acting on the drive shaft 9 will not significantly vary. This ensures the stable operation of the swash plate type compressor with less noise, and less vibration.

In addition, the partition 12 is engaged with the fixed race 11*b* of the bearing 11 in this embodiment. Even if the bearing 11 is allowed to be pushed by the partition 12, therefore, it has no negative affect on the rotation of the drive shaft 9 ensuring its smooth rotation.

In this embodiment, the pressure of the discharged refrigerant gas led supplied to the second recess can be adjusted by providing a restriction in the passage 29 or changing the shape of the passage 29. It is also possible to adjust the pressure of the suction refrigerant gas led into the first recess by changing the shape of the passage extending to the first recess from inside the swash plate chamber 15. Due to this control of the difference in the pressures of the refrigerant gas first and second recesses, the value of the pre-load force F0 for the compressor can beset to the minimum value necessary for smooth compressor operation.

A second embodiment of the present invention will now be described with reference to FIGS. 2 and 3.

Figure 3:
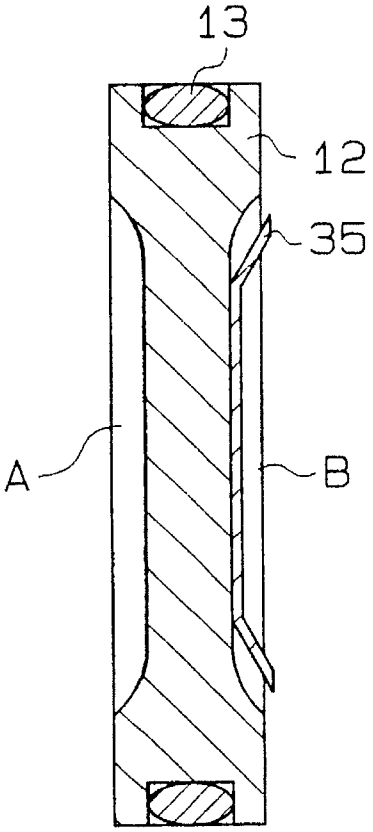
FIG. 3 is an enlarged cross-sectional view of a partition provided in the rear housing of the compressor, and illustrates a second embodiment of this invention.

In this embodiment, a disk spring 35 is provided between the inner wall of the second recess and the rear wall of the partition 12 as urging means for urging the partition 12 frontward, as shown in FIG. 3. Other aspects of this embodiment are the same as that of the first embodiment. In the graph in FIG. 2, a one-dot chain line indicates the value of the compressor's pre-load force. This pre-load force is the value indicated by the solid line plus the spring force F of the disk spring 35. From this diagram, it is apparent that pressure has been applied to the partition 12 since the activation of the compressor, and that a certain level of pre-load force has been applied to the roller bearings 10, 11.

According to the compressor of this embodiment, therefore, even if there is no difference between the pressures in front and at the rear of the partition 12 at the time the compressor is activated, the rattling of the drive shaft 9 can be prevented, thus suppressing compressor's vibration and noise. The working tolerance between the partition 12 and the rear housing 8, which is normally the cause of the drive shaft's rattling, can be increased if need be, without degrading the performance of the compressor.

In this embodiment, means for urging the partition 12 toward the swash plate need not be limited to the disk spring 35, but may be by any means so long as it results in the same action that the disk spring 35 has on the partition 12. For example, a coil spring, a leaf spring or the like may be used as the urging means.

Figure 4:
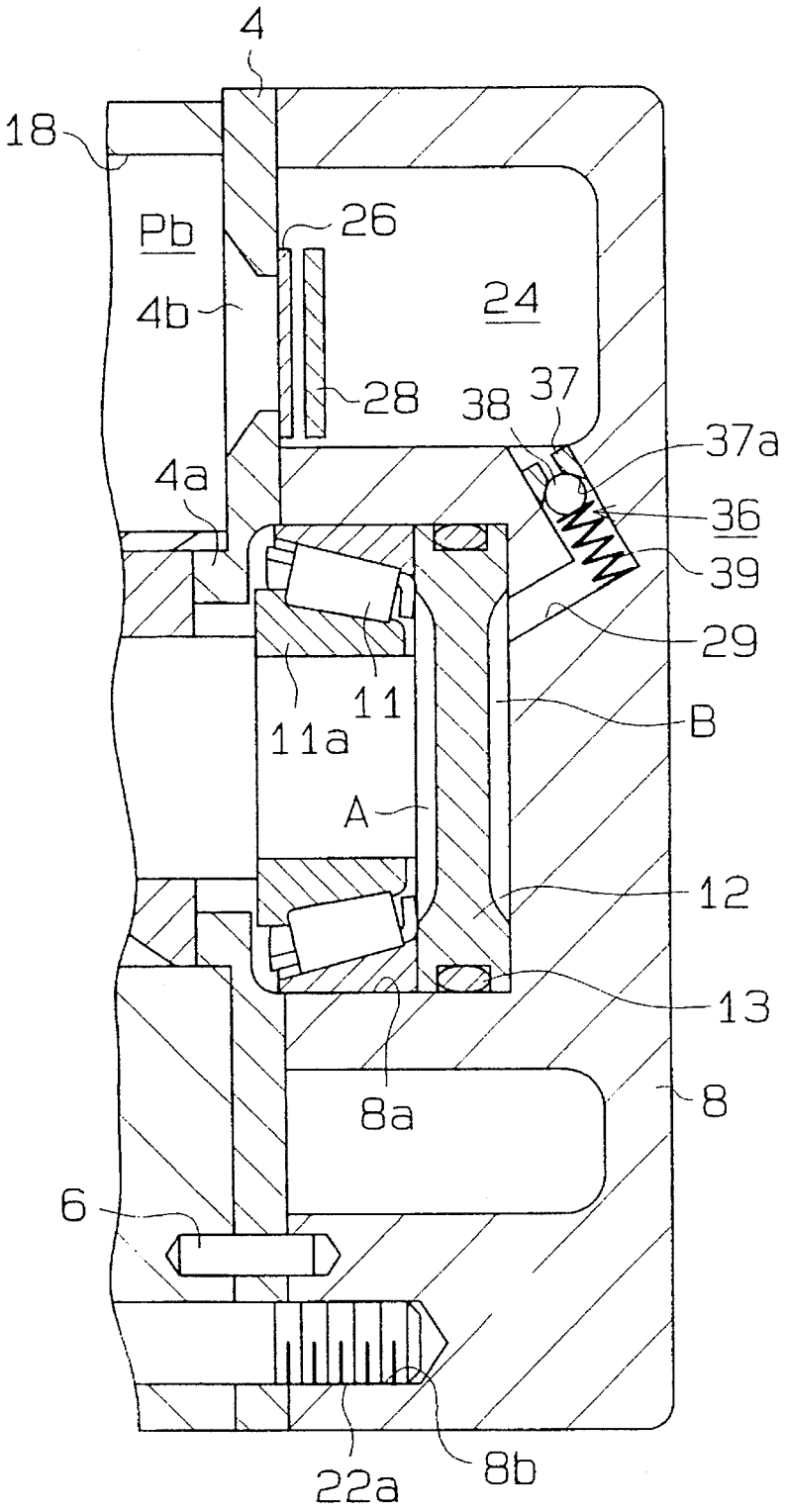
FIG. 4 is an enlarged cross-sectional view of a portion of the compressor containing a check value, illustrative of a third embodiment according to the present invention.
Figure 5:
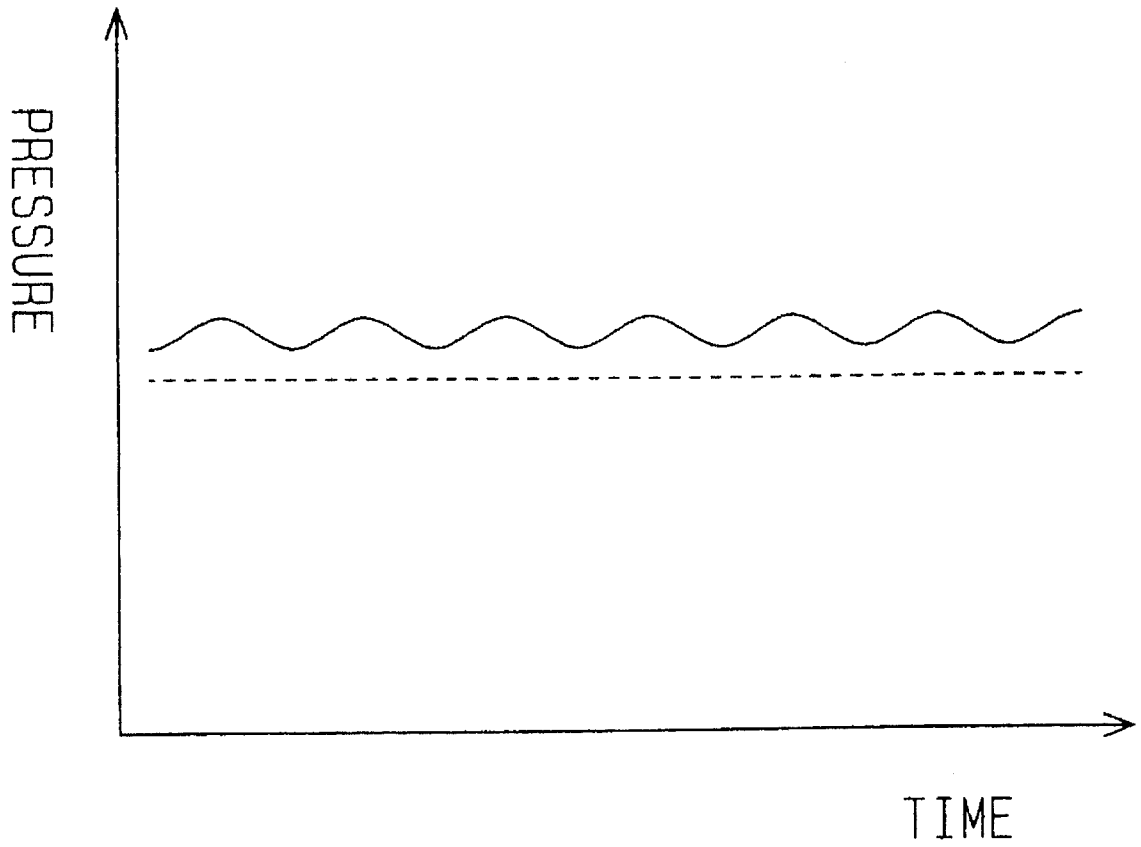
FIG. 5 is a graph illustrating the relationship between the pressure of a refrigerant gas discharged to a discharge chamber and refrigerant gas discharged to a second recess in the partition as described according to a third embodiment of the present invention.

A third embodiment of the present invention will now be describes with reference to FIGS. 4 and 5.

In the third embodiment, a check valve 36 is disposed in the passage 29 which connects the discharge chamber 24 to the second recess as shown in FIG. 4. This check valve 36, which is press-fit in the passage 29, comprises a nearly cylindrical valve seat 37 having a seat face 37*a* at one end, a ball 38 which abuts on the seat face 37*a* of the valve seat 37 from the side of the second recess to close the passage 29, and a coil spring 39 for urging the ball 38 toward the seat face 37*a*. The check valve 36 permits only the supply of the discharge refrigerant gas to the second recess from the discharge chamber 24, and inhibits the counter-flow of the pressure of the supplied gas toward the discharge chamber 24. The check valve 35 is designed in such a way that, when closed, it does not fully obstruct the passage 29 but permits a certain level of gas pressure leaking to the discharge chamber 24. The other structure of this embodiment is entirely the same as that of the first embodiment.

In FIG. 5, the solid line represents the pressure of the refrigerant gas discharged into the chamber 24 as the compressor runs, while the broken line represents the pressure of the refrigerant gas supplied to the second recess via the check valve 36 in the passage 29. It is apparent from this diagram that even when the refrigerant gas is discharged into the discharge chamber 24 under pulsating conditions, the pulsation component of the pressure is not transmitted to the second recess, thus ensuring stable gas pressure inside the second recess in the compressor.

In other word, once a high gas pressure is introduced into the second recess, the check valve 36 inhibits the gas pressure therein from falling. Therefore, the gas pressure in the second recess will not vary with changes in pressure caused by the pulsation of the discharge refrigerant gas. Nor will the pre-load force applied to the bearings 10, 11 be affected by the pulsation of the discharge refrigerant gas. In addition, even in the cases where there is rapid decreases in the difference between the suction and discharge refrigerant gas pressures, due to a sharp fall in the cooling load, the gas pressure in the second recess will not fall suddenly. This prevents the pre-load force applied to the bearings 10, 11 from decreasing too rapidly and consequently from destabilizing the drive shaft 9. According to the compressor of this embodiment, therefore, even if the discharge refrigerant gas is pulsated or the cooling load falls suddenly, the drive shaft 9 does not rattle, thus suppressing the compressor's vibration and noise.

Further, in the on-off operation of the compressor, even when the compressor is stopped and is later activated, there is high possibility that the pressure of the discharge refrigerant gas previously supplied to the second recess will still remain in the second recess. In such a case, pressure would be applied to the partition 12. In this embodiment, therefore, a certain level of pre-load force is applied to the roller bearings 10, 11 from the beginning of the activation of the compressor's on-off operation. This prevents the rattling of the drive shaft 9 while suppressing the compressor's vibration and noise.

As described above, the check valve 36 is designed in such a manner as to permit a certain level of gas pressure to leak to the discharge chamber 24. When the level of the cooling load changes, therefore, gas pressure in the second recess can sufficiently change to allow the pro-load applied to the bearings 10, 11 to change as needed. This further prevents problems from occurring with a change in thrust load acting on the drive shaft 9.

In this embodiment, the pressure of the discharge refrigerant gas led into the second recess can be adjusted by changing the spring force of the coil spring 39 of the check valve 36. By adjusting the gas pressure in the second recess, therefore, the set value of the pre-load for the compressor can easily be set slightly larger than the thrust load acting on the drive shaft 9.

The present invention is not limited to the above-described embodiments, but may be embodied in the following modes.

(1) This invention may be applied to a compressor which uses single-head pistons. In this case, the action of the pre-load is directed against the load that is applied to the drive shaft by the compression.

(2) This invention may be applied to a variable displacement type compressor.

(3) In the third embodiment, the check valve 36 may be replaced with another type of valve, such as a flapper type valve.

(4) This invention may be applied to the wave plate type compressor.

What is claimed is:

1. A compressor having a disk mounted on a rotary drive shaft and operably coupled to a piston for converting a rotation of the drive shaft to a reciprocating movement of the piston to compress refrigerant gas in a cylinder bore with a compressive force according a cooling load, and an element for biasing the drive shaft in the direction counter to a thrust load applied on the drive shaft and resulted from the compressive force working on the drive shaft, said element comprising:

means for generating a pre-load force substantially counterbalancing the thrust load force said generating means including a retaining chamber formed in the vicinity of an end of the drive shaft and a partition housed in the chamber, said partition defining a first recess and a second recess to which the compressed gas is supplied under pressure in proportion to the cooling load; and means for transmitting the counterbalancing pre-load force to the drive shaft.

2. The compressor as set forth in claim 1 further comprising a first thrust bearing connected with the partition and supporting an end portion of the drive shaft.

3. The compressor as set forth in claim 2 further comprising a second thrust bearing which supports the drive shaft at an opposed portion to the end portion.

4. The compressor as set forth in claim 3 further comprising:

a housing including a front portion and a rear portion;

a discharge chamber formed in the rear portion and communicating with the cylinder bore; and a pressure path for connecting the discharge chamber with the retaining chamber.

5. The compressor as set forth in claim 1 further including a spring for biasing the partition in the direction counter the thrust load force.

6. The compressor as set forth in claim 4 further comprising a check valve for preventing a pulsation of the pressure being transferred from the discharge chamber to the retaining chamber.

7. A compressor having a disk mounted on a rotary drive shaft and operably coupled to a piston for converting a rotation of the drive shaft to a reciprocating movement of the piston to compress refrigerant gas in a cylinder bore with a compressive force according a cooling load, and an element for biasing the drive shaft in the direction counter to a thrust load applied on the drive shaft and resulted from the compressive force working on the drive shaft, said element comprising:

a retaining chamber formed in the vicinity of an end of the drive shaft;

a partition housed in the chamber, said partition defining a first recess and a second recess to which the compressed gas is supplied under pressure in proportion to the cooling load; and a first thrust bearing connected with the partition and supporting an end portion of the drive shaft.

8. The compressor as set forth in claim 7 further comprising:

a housing having a front portion and a rear portion;

a discharge chamber formed in the rear portion and communicating with the cylinder bore; and a pressure path for connecting the discharge chamber with the retaining chamber.

9. The compressor as set forth in claim 7 further including a spring for biasing the partition in the direction counter the thrust load force.

10. The compressor as set forth in claim 7 further comprising a check valve for preventing a pulsation of the pressure being transferred from the discharge chamber to the retaining chamber.

11. A compressor having a disk mounted on a rotary drive shaft and operably coupled to a piston for converting a rotation of the drive shaft to a reciprocating movement of the piston to compress refrigerant gas in a cylinder bore with a compressive force according a cooling load, and an element for biasing the drive shaft in the direction counter to a thrust load applied on the drive shaft and resulted from the compressive force working on the drive shaft, said element comprising:

a retaining-chamber formed in the vicinity of an end of the drive shaft;

a partition housed in the chamber, said partition defining a first recess and a second recess to which the compressed gas is supplied under pressure in proportion to the cooling load;

a housing including a front portion and a rear portion;

a first thrust bearing connected with the partition and supporting an end portion of the drive shaft;

a discharge chamber formed in the rear portion and communicating with the cylinder bore; and a pressure path for connecting the discharge chamber with the retaining chamber.

12. The compressor as set forth in claim 11 further including a spring for biasing the partition in the direction counter the thrust load force.

13. The compressor as set forth in claim 11 further comprising a check valve for preventing a pulsation of the pressure being transferred from the discharge chamber to the retaining chamber.

* * * * *